US008351815B2

(12) United States Patent
Eden et al.

(10) Patent No.: US 8,351,815 B2
(45) Date of Patent: Jan. 8, 2013

(54) APPARATUS AND METHOD FOR REDUCING VAPOR EMISSIONS FROM A PRINTER

(75) Inventors: Boaz Eden, Rehovot (IL); Danny Gerstenfeld, Ramat Gan (IL); Moshe Peles, Lapid (IL); Peter Nedelin, Ashdod (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 277 days.

(21) Appl. No.: 12/839,372

(22) Filed: Jul. 19, 2010

(65) Prior Publication Data

US 2012/0014707 A1 Jan. 19, 2012

(51) Int. Cl.
*G03G 21/20* (2006.01)

(52) U.S. Cl. ..... 399/92; 399/93

(58) Field of Classification Search ..... 399/92–93
See application file for complete search history.

(56) References Cited

U.S. PATENT DOCUMENTS

| | | | | |
|---|---|---|---|---|
| 3,890,721 | A * | 6/1975 | Katayama et al. | 34/73 |
| 4,760,423 | A * | 7/1988 | Holtje et al. | 399/250 |
| 5,737,674 | A | 4/1998 | Venkatesan et al. | |
| 6,383,296 | B1 | 5/2002 | Burgard | |
| 6,477,347 | B2 * | 11/2002 | Yokota et al. | 399/250 |
| 7,187,885 | B2 | 3/2007 | Baker et al. | |
| 7,370,957 | B2 | 5/2008 | Yamashita et al. | |
| 2002/0090232 | A1 * | 7/2002 | Pang et al. | 399/250 |
| 2005/0244184 | A1 * | 11/2005 | Kim et al. | 399/93 |
| 2007/0009283 | A1 * | 1/2007 | Shirakata et al. | 399/92 |
| 2007/0122177 | A1 * | 5/2007 | Doi | 399/93 |
| 2009/0111043 | A1 | 4/2009 | Joo et al. | |

OTHER PUBLICATIONS

Lauren Barker, "Reducing Volatile Organic Compounds to Zero to Meet Future Industrial Environmental Standards," Graphic Communication, Cal Poly; GRC 329—Web Offset and Gravure Printing Technologies Class, Fall Quarter.

"Volatile Organic Compounds in Consumer and Commercial Products,"The Canadian Printing and Publications Industry (http://www.ec.gc.ca/nopp/voc/en/secP.cfm).

Dave Chiles, "The Basics of VOC Capture Systems," Pro-Environmental, Inc (Feb. 2002).

Doreen M. Monteleone et al, "Reducing Ink and Solvent use in Enclosed Flexographic Inking Systems" Printers' National Environmental Assistance Center, (http://www.pneac.org/sheets/flexo/inkingsystems.pdf).

* cited by examiner

*Primary Examiner* — David Gray
*Assistant Examiner* — G. M. Hyder

(57) ABSTRACT

An apparatus for reducing vapor emissions from a printer may include a treatment chamber having an inlet and an outlet. While the printer is operating, vapor-laden air may enter the treatment chamber via the inlet and treated air may exit the treatment chamber via the outlet. While the printer is idle, the inlet and outlet can be sealed to prevent vapors located in the treatment chamber from being emitted to the atmosphere.

17 Claims, 4 Drawing Sheets

APPARATUS AND METHOD FOR REDUCING VAPOR EMISSIONS FROM A PRINTER

BACKGROUND

Materials such as paints, aerosols, varnishes, polishes, coatings, and oils may emit volatile organic compounds (VOCs) and other air pollutants, some of which may contribute to the formation of ground level ozone or smog. These emissions may be regulated by local and national regulatory agencies to protect the environment and/or health of the populace. In a printer or press, printing ink may be mixed with oil or other solvents that may emit such compounds. It would be desirable to reduce the emission of such compounds from these printers.

Figure 1:
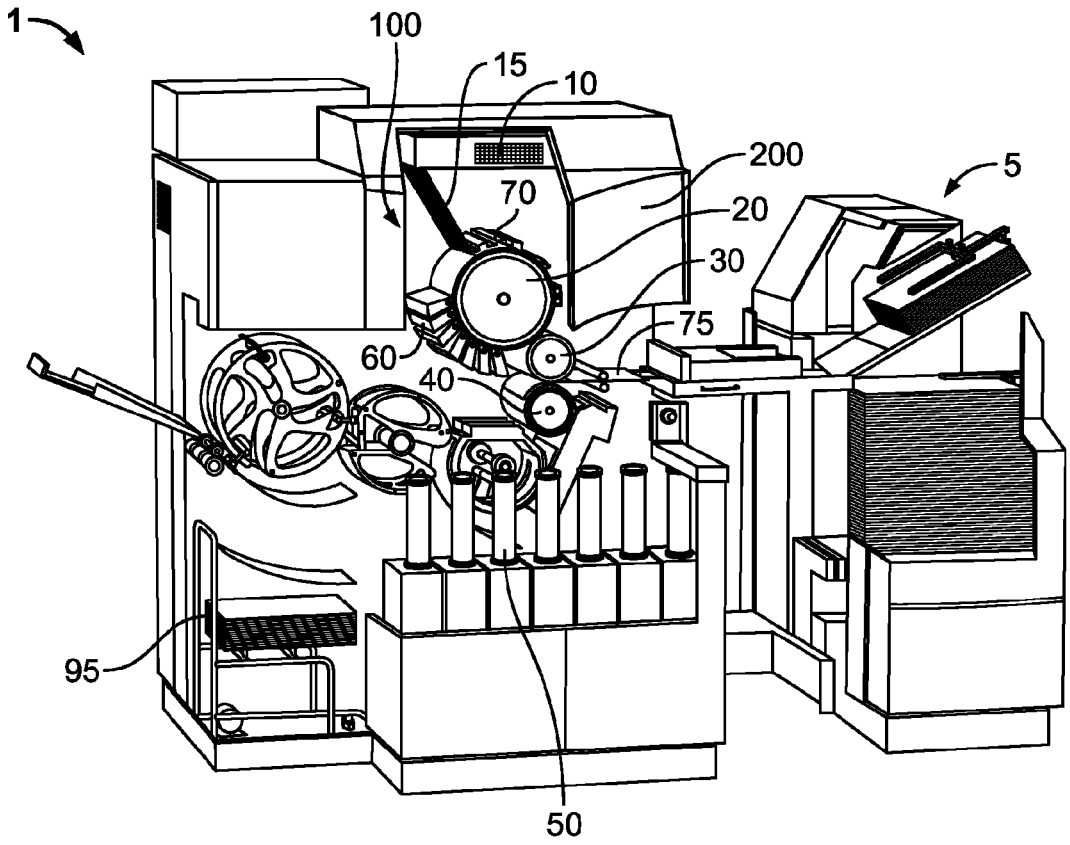
FIG. 1 is a schematic illustration of a printer according to embodiments of the invention.

Where considered appropriate, reference numerals may be repeated among the drawings to indicate corresponding or analogous elements. Moreover, some of the blocks depicted in the drawings may be combined into a single function.

DETAILED DESCRIPTION

In the following detailed description, numerous specific details are set forth in order to provide a thorough understanding of embodiments of the invention. However, it will be understood by those of ordinary skill in the art that the embodiments of the present invention may be practiced without these specific details. In other instances, well-known methods, procedures, components, and circuits have not been described in detail so as not to obscure the present invention.

Embodiments of the present invention may be used in a variety of applications. Although the present invention is not limited in this respect, the techniques disclosed herein may be used in paper handling machines such as printers, presses, copiers, multi-function printers, and the like.

In some printers or presses, the oil that carries the printer ink may evaporate into the atmosphere, emitting hydrocarbons including VOCs in the process. Embodiments of the present invention operate to reduce vapor emissions, including VOCs, from such a printer by treating in a chamber, while the machine is operating, vapor-laden air and sealing inlets to the chamber, while the machine is idle, from which the vapors may otherwise escape to the atmosphere.

Reference is now made to FIG. 1, which is a schematic illustration of a printer 1 according to embodiments of the invention. Printer 1 may include a printing area 100 (or printing engine) that includes writing head 10, photo imaging plate (PIP) drum 20, intermediate transfer medium (ITM) drum 30, impression drum 40, ink containers 50, ink rollers 60, and scorotrons 70. Printer 1 may also include paper handling areas, such as paper feed unit 5 (including paper trays) and output paper stacker 95. Printer 1 may also include cooling cabinet 200, discussed in more detail below.

The parts and blocks shown in FIG. 1 are examples of parts that may comprise printer 1, and do not limit the parts or modules that may be part of or connected to or associated with printer 1.

Embodiments of the present invention may use a liquid electrophotography (LEP) process to print on a substrate 75, such as coated or uncoated paper or card stock or other media. In LEP, scorotrons 70 charge PIP drum 20. Writing head 10 then uses scanning laser beam 15 to electrostatically charge a latent image onto PIP drum 20. A colorant, such as liquid ink or toner, stored in ink containers 50, may be applied to charged PIP drum 20, using ink rollers 60 (also called "binary ink developers" (BID)). This colorant may be transferred to ITM drum 30, or, more precisely, to a blanket wrapped around ITM drum 30, and then transferred from the blanket to substrate 75 using impression drum 40 to form the image on the substrate.

Liquid ink or toner (an example of which is Hewlett-Packard's ElectroInk®) used in LEP may be a combination of a solid pigment in a liquid solvent or carrier. The solid part may be paste-like and may include micron-sized electrically charged particles. The liquid solvent may be an oil, or an oil mixture (such as HP Imaging Oil), which may include an isoparaffinic fluid such as Isopar® or Isopar-L (made by ExxonMobil Chemical Co.).

Figure 2:
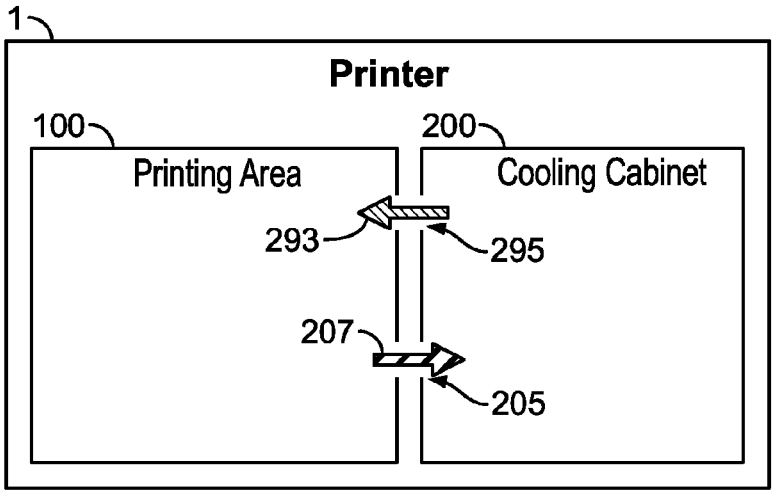
FIG. 2 is a conceptual block diagram of part of a printer according to embodiments of the invention.

During printing, the ink paste may be mixed with the imaging oil and then delivered to the printing area. After printing, the substrate may be dried by evaporating the liquid (oil) part of the ink from the printed image, and then cooling the vapor in a cooling cabinet to recover the oil. This process is shown generally in a conceptual block diagram in FIG. 2, which includes printing area 100 and cooling cabinet 200. Warm oil vapor 207 is shown exiting printing area 100 and entering cooling cabinet 200 via inlet 205. Cooling cabinet 200 cools the vapor to condense the oil, and then cool air 293 exits cooling cabinet 200 and enters printing area 100 via outlet 295.

Figure 3A:
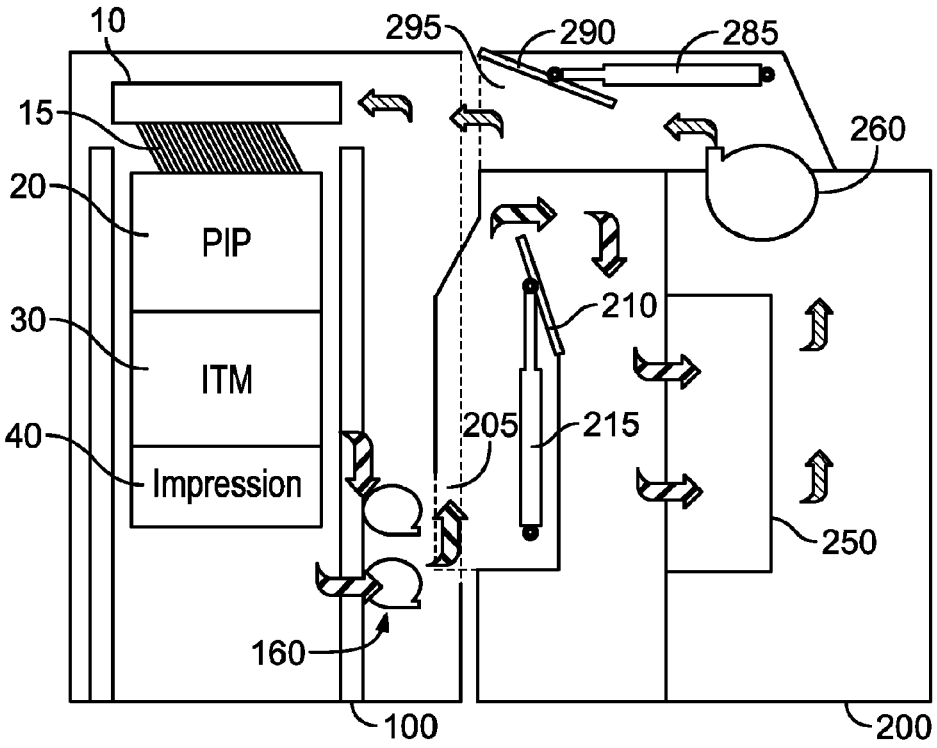
FIGS. 3A and 3B are conceptual illustrations of the air flows through parts of a printer when inlet doors are open and closed, respectively, according to embodiments of the invention.

FIG. 3A shows in more detail the cooling operation between printing area 100 and cooling cabinet 200. Blowers (or evaporators) 160 suck warm vapor-laden air (oil vapor) from a freshly-printed image (e.g., from impression drum 40 or I™ drum 30) and blow it through inlet 205 to cooling cabinet 200. The oil vapor enters heat exchanger 250, which may use cold water to cool the vapor down to 40-50° F. (4-10° C.) and condense the oil from the vapor. The condensed oil is mixed with the ink paste again to be used for further printing. Blower 260 blows the treated air through outlet 295 to printing area 100.

Figure 3B:
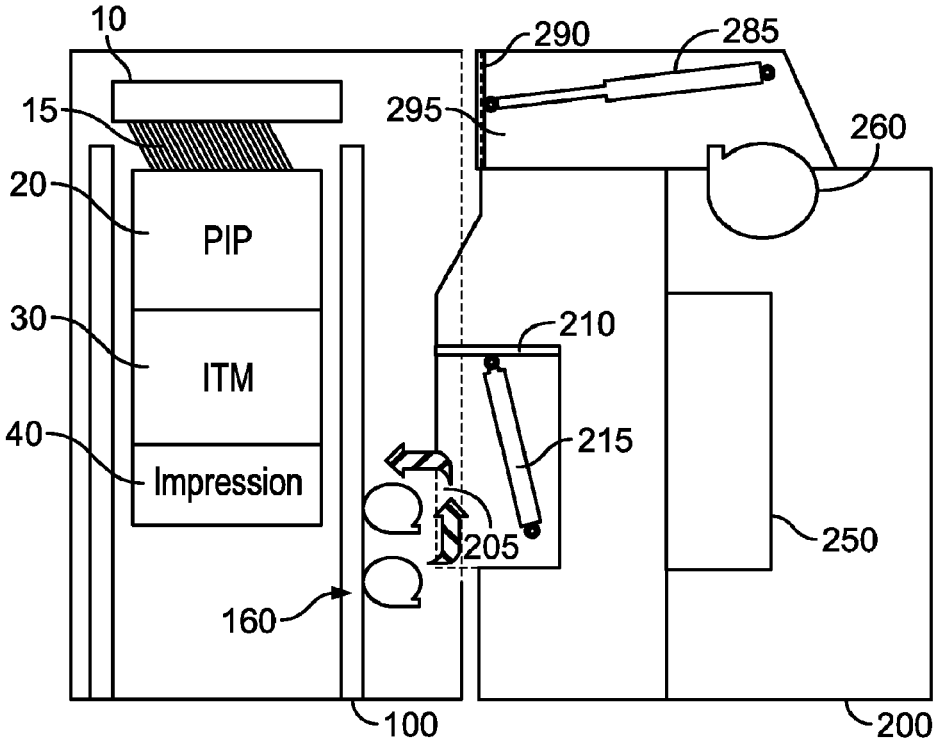

Also shown in FIG. 3A are inlet door 210 and outlet door 290, the opening and closing of which are controlled using hydraulic cylinders 215 and 285, respectively. Inlet door 210 and outlet door 290 are used to control the emission of VOCs and other compounds from the printer to the atmosphere. More specifically, when the printer is operating, inlet door 210 and outlet door 290 are open to allow for the flow of oil vapor and oil between cooling cabinet 200 and printing area 100. Because blowers 160 and 260 are operating when the printer is operating, VOCs and other compounds do not escape from the printer into the atmosphere. When the printer is idle, however, inlet door 210 and outlet door 290 are closed, as shown in FIG. 3B, to prevent the oil from evaporating from cooling cabinet 200. Blowers 160 and 260 are also shut off to eliminate convection in cooling cabinet 200, which would tend to spread the vapors.

Besides the benefit of controlling VOC and other vapor emissions (at least 40% reduction in some instances for the printer as a whole), having the ability to open and close the inlet and outlet doors retains and saves the oil (as much as 98% of the printer oil, which may constitute three to four liters or more per day), which can be used when the press begins operating again (e.g., the next day), so much less oil is used and wasted.

Figure 4A:
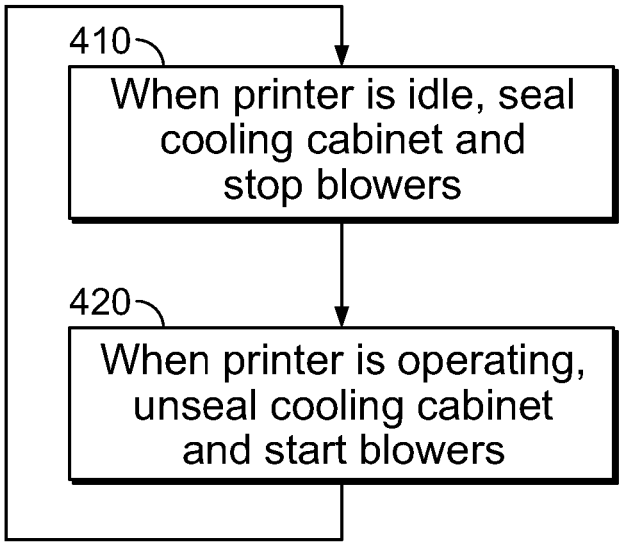
FIGS. 4A and 4B are flowcharts illustrating processes to reduce VOC emissions according to embodiments of the invention.
Figure 4B:
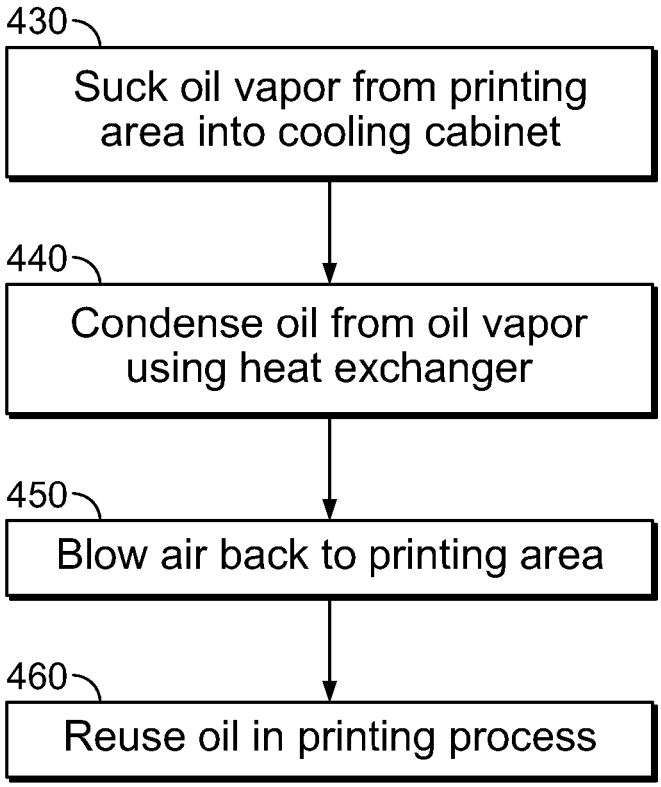

Reference is now made to FIGS. 4A and 4B, which are flowcharts showing the operation of embodiments of the present invention. In FIG. 4A, a general process of the present invention may include several operations. In operation 410, the cooling cabinet may be sealed while the printer is idle to keep the VOCs and other vapors from escaping. Blowers 160, 260 may also be shut off to prevent convection of the vapor-laden air. In operation 420, the cooling cabinet may be unsealed and the blowers started while the printer is operating. These two operations may operate in a cycle.

In FIG. 4B, while the cooling chamber is unsealed, in operation 430, oil vapor may be sucked from printing area 100 into cooling cabinet 200, possibly using blowers 160. In operation 440, oil may be condensed from the oil vapor using heat exchanger 250. In operation 450, treated air may be blown back to printing area 100, possibly using blower 260. In operation 460, oil may be reused in the printing process.

Besides the flowcharts in FIGS. 4A and 4B, other operations or series of operations may be used. Moreover, the actual order of the operations in the flowcharts may not be critical.

Figure 5A:
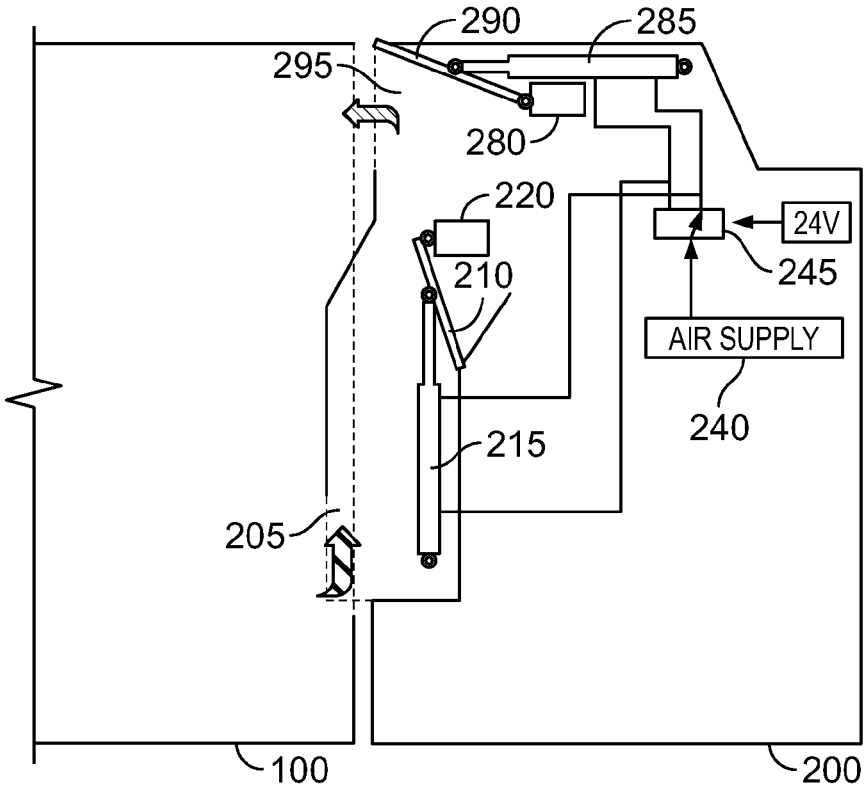
FIGS. 5A and 5B are conceptual illustrations of the interlock control in parts of a printer when inlet doors are open and closed, respectively, according to embodiments of the invention.
Figure 5B:
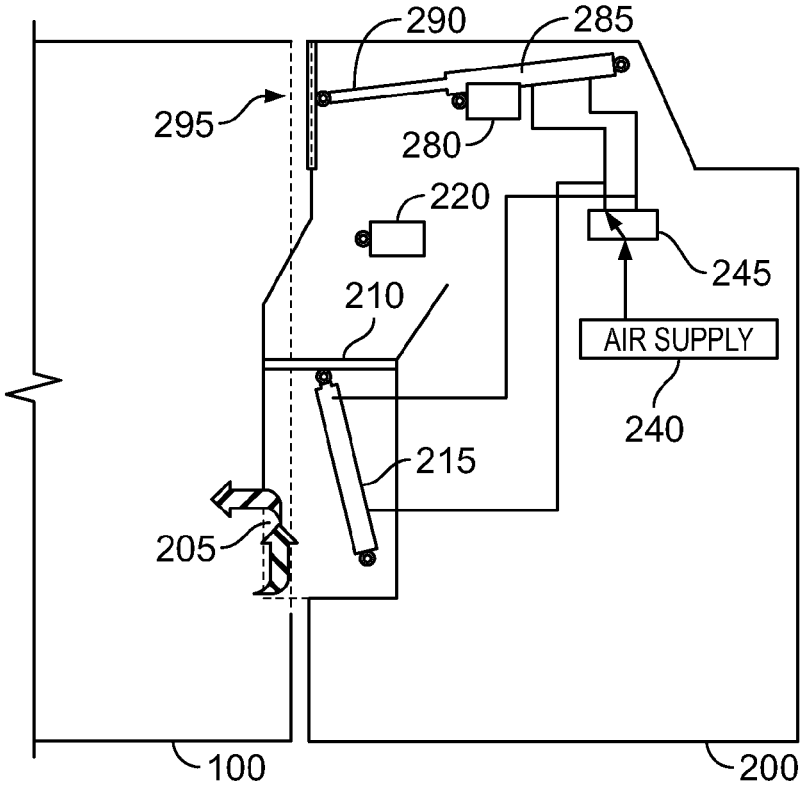

Reference is now made to FIGS. 5A and 5B, which are conceptual illustrations of the mechanism that controls the opening and closing of the inlet and outlet doors. The system may be controlled using a valve 245, controlled by, for example, an electrical signal, e.g., a 24V signal. When printer 1 is operating, valve 245 controls air from air supply 240 to cause hydraulic cylinders 215 and 285 to open doors 210 and 290. When the inlet and outlet doors 210, 290 are opened, they each engage an interlock 220, 280, respectively, which confirms to printer 1 that the doors are open. When the machine is idle, valve 245 is closed, causing inlet and outlet doors 210, 290 to be closed. FIG. 5B shows no air flow into inlet 205 from printing area 100. Upon startup of printer 1, inlet and outlet doors 210, 290 are closed. Heat exchanger 250 is started up in order to begin condensing the oil vapor already within cooling cabinet 200. Then, the inlet and outlet doors 210, 290 are opened and blowers 160, 260 are started to ensure that the vapors can be captured immediately. Interlocks 220, 280 ensure that blowers 160, 260 are not activated before inlet and outlet doors 210, 290 are opened.

Prior attempts to reduce VOC or other emissions included capturing these compounds and destroying them or diverting them to other locations or adding small permanent enclosures around the whole press or large permanent enclosures around the press room or warehouse. These methods still emit the compounds, however. In flexographic printing, which uses an embossed relief plate as in offset printing, enclosed doctor blade chambers have been used to enclose the area right next to the main ink drum (within the printing area), scrape off excess ink from the drum with one or two blades, and return the ink to a reservoir to be used again. But these chambers do not control VOCs emitted from the other printing drums, the printed substrate, or the printing area as a whole. They also do not open and close depending on the operational status of the printer.

In sum, a novel arrangement is described that may be used to reduce VOC or other emissions from a printer, press, or copier by using doors to seal, typically while the machine is idle, inlets to the chamber from which the compounds may escape to the atmosphere. This limits environmental emissions of these compounds. Other benefits of the arrangement are reduced oil consumption, because the oil stays in the printer rather than evaporating to the atmosphere, reduced maintenance, because there is no need to refill oil each day, reduced operation cost, because of the saving of the cost of oil, and reduced environmental impact, because there is less of a need to produce oil.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications. It is also intended that the word "printer" in the claims include apparatuses such as presses and copiers, in addition to printers.

The invention claimed is:

1. An apparatus for reducing vapor emissions from a printer, comprising:

a treatment chamber including: an inlet through which vapor-laden air may enter the treatment chamber while the printer is operating, the inlet having an inlet door for sealing the inlet;

and an outlet through which treated air may exit the treatment chamber while the printer is operating, the outlet door having an outlet door for sealing the outlet;

wherein the inlet and outlet can be sealed while the printer is idle to prevent vapors located in the treatment chamber from being emitted to the atmosphere.

2. The apparatus of claim 1, further comprising hydraulic cylinders connected to said inlet and outlet doors to open and close said inlet and outlet doors.

3. The apparatus of claim 1, wherein said inlet and outlet doors are closed to prevent vapors from being emitted from the treatment chamber.

4. The apparatus of claim 1, further comprising interlocks to ensure that said inlet and outlet doors are not open until the printer is operating.

5. The apparatus of claim 1, wherein the treatment chamber is a cooling cabinet.

6. The apparatus of claim 5, wherein the cooling cabinet comprises a heat exchanger for cooling vapor-laden air from a printing area of the printer.

7. The apparatus of claim 6, wherein the vapor-laden air contains oil vapor.

8. A liquid electrophotography printer comprising:

a printing area;

and a treatment chamber in fluid communication with said printing area, said treatment chamber comprising: an inlet through which vapor-laden air can enter from said printing area;

an inlet door adjacent to said inlet;

an outlet through which treated air can enter said printing area;

and an outlet door adjacent to said outlet;

wherein said inlet and outlet doors for closing off said inlet and outlet when the printer is idle;

and wherein said treatment chamber can condense solvent from the vapor-laden air while the printer is operating, and the vapor-laden air is prevented from escaping to the atmosphere while the printer is idle.

9. The printer of claim 8, wherein the closing of said inlet and outlet doors can prevent vapors within the vapor-laden air from being emitted from the treatment chamber.

10. The printer of claim 8, wherein the treatment chamber is a cooling cabinet.

11. The printer of claim 8, wherein the vapor-laden air contains oil vapor.

12. A method for reducing vapor emissions from a printer, comprising:

when the printer is operating:

withdrawing air from a printing area to a treatment chamber;

treating the air in the treatment chamber to remove solvent from the air, said solvent producing said vapor emissions;

and recirculating treated air from the treatment chamber back to the printing area; and, opening inlet and outlet doors between said printing area and said treatment chamber;

and when the printer is idle:

sealing the treatment chamber against the release of vapors from the treatment chamber.

13. The method of claim 12, wherein the treatment chamber is a cooling cabinet.

14. The method of claim 13, wherein the treating comprises condensing said solvent from the air.

15. The method of claim 12, wherein said sealing comprises closing inlet and outlet doors of between said printing area and said treatment chamber.

16. The method of claim 12, further comprising shutting off blowers in the printing area and the treatment chamber.

17. The method of claim 12, wherein the sealing of the treatment chamber prevents the vapors from evaporating into the atmosphere.

* * * * *